United States Patent [19]

Lamb

[11] 4,060,860

[45] Dec. 6, 1977

[54] BRAKING SYSTEM FOR MOTORIZED SWIMMING POOL COVERS

[76] Inventor: Joe H. Lamb, 3500 Hillside Lane, Salt Lake City, Utah 84109

[21] Appl. No.: 672,162

[22] Filed: Mar. 31, 1976

[51] Int. Cl.[2] ..... E04H 3/16; E04H 3/18

[52] U.S. Cl. ..... 4/172.14; 4/172.12; 160/298

[58] Field of Search ..... 4/172.12, 172.11, 172.13, 4/172.14, 172; 160/298, 368, 291, 296, 298; 188/71, 166, 83.5

[56] References Cited

U.S. PATENT DOCUMENTS

| | | | |
|---|---|---|---|
| 1,771,015 | 7/1930 | Simpson | 160/298 |
| 1,799,137 | 3/1931 | Simpson | 160/298 |
| 2,166,745 | 7/1939 | Appel | 160/298 |
| 2,277,134 | 3/1942 | Nelson | 188/71.5 X |
| 2,341,440 | 2/1944 | Hammer | 160/298 |
| 3,050,743 | 8/1962 | Lamb | 4/172.14 |
| 3,070,811 | 1/1963 | Bender | 4/172.14 |
| 3,275,109 | 9/1966 | Ganley | 188/83 X |
| 3,277,498 | 10/1966 | Kleinbard et al. | 4/172.14 |
| 3,295,647 | 1/1967 | Murphy | 188/71.5 |
| 3,426,366 | 2/1969 | Bailey et al. | 4/172.14 |
| 3,434,570 | 3/1969 | Freholm | 188/83 |
| 3,735,843 | 5/1973 | Wiig | 188/166 |
| 3,885,255 | 5/1975 | Vorbach et al. | 4/172.14 |

*Primary Examiner*—Henry K. Artis
*Attorney, Agent, or Firm*—Richard F. Bojanowski

[57] ABSTRACT

A braking system has been designed for controlling the rotational momentum of a cover collecting drum during the extention and retraction sequence of a motorized swimming pool cover apparatus. The braking system provides a compact, substantially even roll on the collecting drum. The swimming pool cover apparatus includes a rotatable and axially slidable shaft supportably carried by a number of end bearing standards. A fixed, free wheeling, cover collecting drum is carried on the shaft along with a pair of free wheeling, draw cord collecting reels positioned at each end of the drum. A clutch-like system is provided whereby the drum and the reels can be selectively engaged and/or disengaged from the shaft by rotating the shaft first in one direction then in the other. To maintain a desired, preselected tension on the pool cover and thereby produce a compact, even roll on the cover collecting drum the rotational momentum of the reels and the cover collecting drum is controlled during operation by the application of an adjustable braking force to each of the reels. This braking force is achieved by squeezing or pinching a pair of brake shoes against the side walls of each of the reels. Since the force applied to the reel's side walls is adjustable, the braking force applied to the reels may either be identical or dissimilar depending upon the type and degree of compactness or tightness desired. A unique feature of this braking system is that the desired amount of force can be applied concomitantly to both side walls of each of the reels and thereby insure a uniform roll on the cover collecting drum.

3 Claims, 7 Drawing Figures

BRAKING SYSTEM FOR MOTORIZED SWIMMING POOL COVERS

BACKGROUND OF THE INVENTION

1. Field of the Invention

This invention is directed to a pool covering apparatus and particularly to an extendable and retractable swimming pool cover adapted with a braking system for controlling the rotational momentum of a clutch cover collecting drum and thereby insure that a uniform, compact roll is collected on the cover collecting drum.

2. State of the Art

The use of swimming pool covers on conventional and residential type swimming pools is well known. Pool covers are becoming standard equipment for maximizing pool safety as well as reducing unwanted debris from entering the swimming pool when it is not in use. In addition, the use of pool covers will minimize heat loss from pool waters and can also be used to utilize the sun's rays to heat the pool water during daylight hours.

Most motorized pool covering apparatus includes a recessed well or a raised housing positioned at one end thereof and having mounted therein an elongated drum fixed to a rotatable shaft which in turn is connected to an electric motor. An impervious flexible pool cover is secured, at one of its ends, to the cover collecting drum and is collectable thereon by rotational movement of the drum. The pool cover is extended over the top of the swimming pool by attaching draw cords to both sides of the pool cover as longitudinal extensions thereof, and extending the draw cords the length of the pool and around a pulley rotatably fixed to the other side thereof. The draw cord is returned and secured to a collecting reel which is rotatably carried on the same elongated shaft that carries the cover collecting drum. By energizing an electric motor, the draw cord collecting wheel is automatically slidably engaged to the rotatable shaft permitting the reel to rotate and collect the draw cord thereon. Rotation of the shaft and reel draws the pool cover over the length of the swimming pool and thereby covering same. To maintain the sides of the pool cover in close proximity to the side walls of the swimming pool, a slideway channal is fixed to each of the longitudinal side margins of the swimming pool for engaging a bead formed on the lateral side edges of the pool cover. The beads are formed by folding an elongated strip of the pool cover material or some other suitable sheet material such as canvas or Nylon fixed thereto over a portion of the extended draw cord and securing same thereto by stitching or other means. In so doing, the draw cord, collected on the draw cord collecting reel, becomes a longitudinal propagation of the bead. A beaded pool cover of the type just described is disclosed in U.S. Pat. Nos. 3,050,743 and 3,051,232 and are incorporated herein by reference.

In addition thereto, the above pool cover includes a unique braking system for controlling the tension applied to the pool cover during the extension and retraction sequence and thereby insures that the cover collected or released from the cover collecting drum will be uniform and compact during operation. Basically, this braking system comprises a spring biased pin or pins having a brake shoe fixed to one of its ends and mounted such that the brake shoe will frictionally contact one side or face of a draw cord collecting reel. The use of the above braking mechanism, adequately resolved problems associated with draw cord tangling and uncontrolled rotational movement of the cover collecting drum or the draw cord collecting reel. However, it was found that with the pool cover apparatus heretofore used certain difficulties arose in maintaining a constant and adjustable force on the cover collecting drum and as a result the cover roll collected on the cover collecting drum would be loose and uneven causing the pool cover to bias during the extension and retraction sequence.

OBJECTS OF THE INVENTION

To remedy the above problem it is a primary object of this invention to provide a braking system for use on extendable and retractable pool covers which is readily accessible for adjustment and will provide a cover roll which is uniform, compact and non-biasing. Another object is to provide a braking system which maintains a preselected tension on a swimming pool cover by controlling the rotational momentum of a draw cord collecting reel which in turn is imparted to a cover collecting drum. Still another object of this invention is to provide a braking system which will cause a swimming pool cover to be collected and released evenly from a cover collecting drum. Another object of this invention is to provide a braking system which can be economically produced and easily incorporated on existing swimming pool cover apparatus.

SUMMARY OF THE INVENTION

The braking mechanism of this invention includes a support member, a pair of spaced apart arms mounted at one of its ends to the support member by independent pivotal points for movement in a plane horizontal thereto, opposing brake shoes mounted to said arms and an adjustable and readily accesible means for urging said brake shoes toward each other.

More specifically the braking system of this invention comprises a pair of spaced apart and opposed brake shoes mounted to a pair of arms pivotally fixed at one of its ends to a support member for providing a pinching or squeezing action when urged toward each other. A biased, adjusting means is also provided to urge the opposed pair of pivotally mounted brake shoes into pressurized contact with both side walls or faces of a draw cord collecting reel rotatably mounted in proximity thereto. By tightening the biased adjusting means, the brake shoes are, in effect, squeezed or pinched with a constant force against the side walls or faces of the rotatable draw cord collecting reel. The amount of force exerted on the face of the reel will transmit a corresponding braking force or drag on the reel. The braking system is adapted with a stand or frame which can be used on swimming pool cover apparatus such as those described in U.S. Pat. No. 3,050,743.

DESCRIPTION OF THE PREFERRED EMBODIMENT

Figure 1:
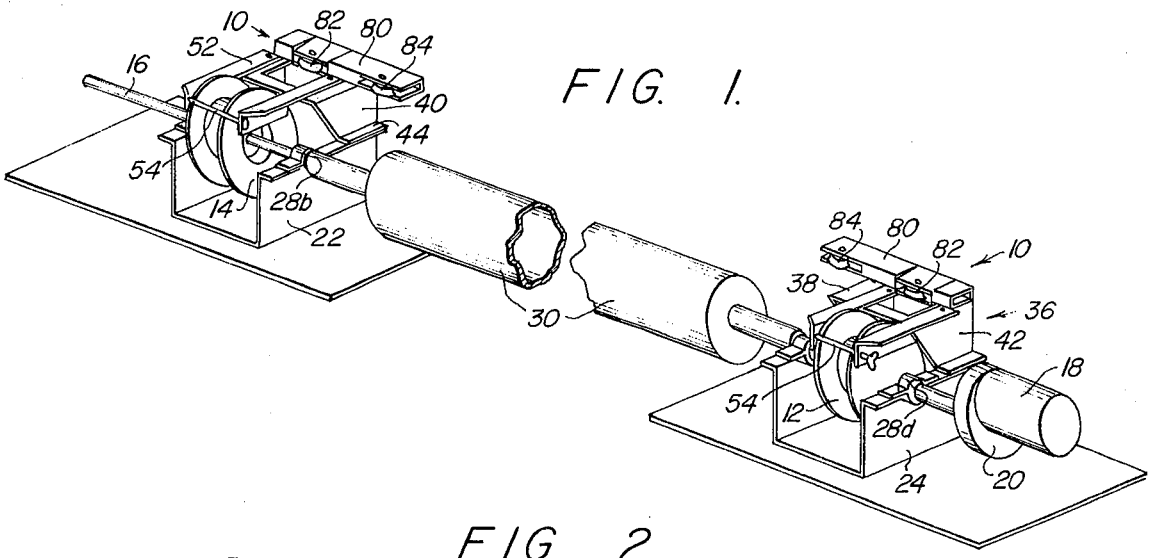
FIG. 1 is a perspective view showing an extendable and retractable swimming pool cover apparatus wherein said apparatus includes a braking mechanism for controlling the rotational momentum of a pair of draw cord collecting reels and a cover collecting drum with portions thereof broken out for convenience of illustration.

As depicted in FIG. 1 the braking system of this invention, which is identified generally by the numeral 10, is mounted in operative relation to a pair of draw cord collecting reels 12 and 14 fixed at or near each end of a rotatable shaft 16.

Figure 4:
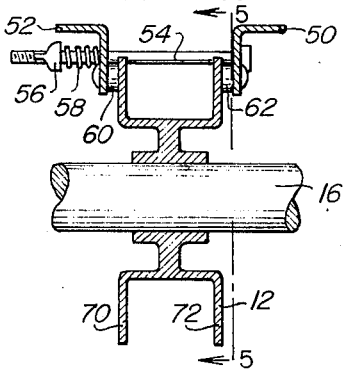
FIG. 4 is a cross-sectional view taken along line 4—4 of FIG. 2.

On one end of the shaft 16 is a reversible electric motor 18 of about ¼ horsepower and a gear speed reducer 20 capable of producing from about 18 to 60 revolutions per minute. Shaft 16 is carried on a pair of journaled end stands 22 and 24 to permit the shaft 16 to rotate freely in either direction. In addition the shaft includes a cam and cam slot or shifting collar 26 (See FIGS. 2 and 4) for inducing the shaft 16 to slide axially within a series of bearing housings 28*a*, 28*b*, 28*c*, and 28*d* fixed to end stands 22 and 24 respectively. The cam and cam slot arrangment 26 permits the shaft 16 to slide axially first in one direction and then the other depending on whether the shaft is turning in a clockwise or a counter-clockwise direction. A pair of clutch engaging means 25 is also provided on each end of the shaft to permit engagement of reels 12 and 14 or a cover collecting drum 30, depending on the direction of rotation of shaft 16. Normally the reels and the cover collecting drum are disengaged and are freely rotatable on shaft 16. However, when the shaft 16 is being rotated in, for example, a clockwise direction, the cover collecting drum 30 becomes engaged, and the draw cord collecting reels become free wheeling. When the rotation of the shaft 16 is rotated, for example, in a counterclockwise direction, the drum is disengaged and the draw cord collecting reels become engaged to shaft 16 and the drum becomes free wheeling. Engagement and disengagement of the drum and the reels are accomplished by means of the clutch engaging means 25 which can be a conventional clutch dog formation adapted to mate with a second clutch dog fixed to shifting collars or a cam and cam slot arrangement 26 operatively connected to the cover collecting drum and the draw cord collecting reels. The cover collecting drum shown in FIGS. 6 and 7 has collected thereon a swimming pool cover 33 with beaded side edges 35. A draw cord 37 continues on from the beaded side edge to the other side of the pool, around pulleys and back as a return line 39 to the draw cord reels. The system above described is depicted and described in greated detail in U.S. Pat. No. 3,050,743 which is hereby incorporated herein by reference for such purpose.

Figure 2:
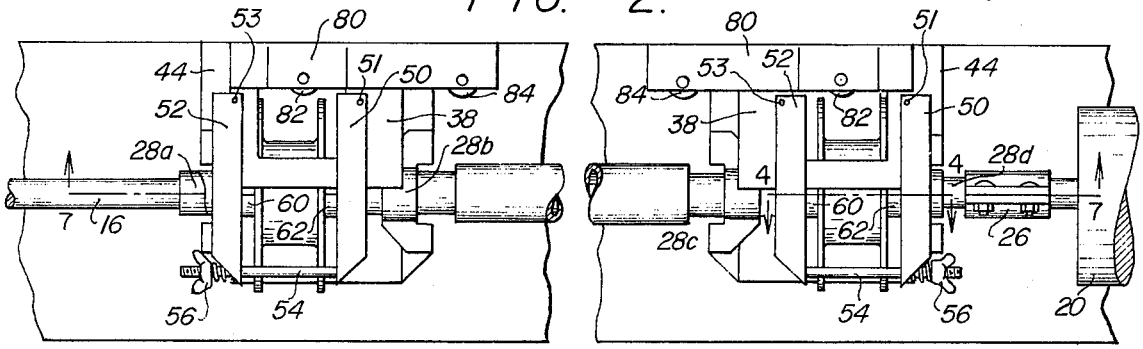
FIG. 2 is an enlarged top plan view of the braking mechanism depicted in FIG. 1 with the cover collecting drum being omitted for purposes of clarity.
Figure 3:
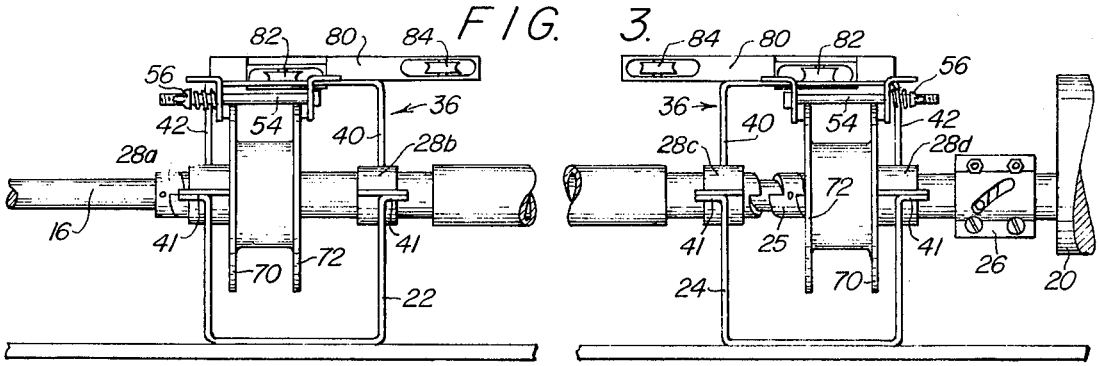
FIG. 3 is a front elevation of the braking mechanism depicted in FIG. 2.
Figure 5:
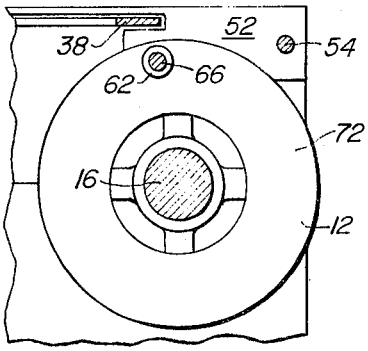
FIG. 5 is a partial side cross-sectional view taken along line 5—5 of FIG. 4.

Refering now to FIGS. 2 and 5 inclusive, it can be seen that the braking mechanism 10 includes a U-shaped frame 36 having a partially open top wall 38 and a pair of side walls 40 and 42. The lower ends of the side walls are bent or lipped 44 and contain openings 46 and 48 for attachment by means of bolts or screws to corresponding lips 41 extending out from the journaled end stands 22 and 24 respectively.

A pair of elongated arms 50 and 52 are pivotally connected at one of its ends by pins 51 and 53 to the top wall 38 of the U-shaped frame 36. The other end of the elongated arms contain a pair of openings for receiving a threaded pin 54. The threaded end of the pin contains a winged nut 56 and a coiled spring member 58. Tightening of the wing nut forces the pivotally mounted arms together as in a pinching action. Intermediate, the pivotal point and the threaded pin are a pair of opposed brake shoes 60 and 62 fastened to the elongated members in opposed relation. The brake shoes are fastened to the elongated members by bonding or other means such as by a recessed bolt or screw 66 more clearly shown in FIG. 5.

Tightening of the nut 56 forces the brake shoes 66 against the side walls 70 and 72 of the draw cord collecting reel 12. The degree of force applied by the brake shoes against the side walls of the reels is directly proportional to the amount of pressure exerted by the spring 58 when wing nut 56 is tightened. The force exerted by each of the shoes 60 and 62 against the side walls 70 and 72 of the reel 12 is essentially the same and can be varied by increasing or decreasing the pinching or squeezing action created by the elongated arms 50 and 52. If the reel is slightly off center, or if the side walls are slightly warped, the squeezing action will provide a substantially constant braking action even though irregularities in the reel may exist.

The positioning of the braking mechanism 10 over the draw cord collecting reel 12 provides a convenient mounting means for the return pulleys 82 and 84 used in extending and retracting the swimming pool cover. These pulleys may be conveniently mounted atop the top wall 38 by means of a housing 80 which rotatably houses pulleys 82 and 84.

In operation, the electric motor 18 is actuated in a clockwise direction causing the shaft to move axially and engage the cover collecting drum 30. When the cover collecting drum 30 is engaged, the drum will rotate in the same direction as the shaft 16 causing the pool cover to be collected thereon. As the pool cover is being retracted the draw cords collected on the reels 12 and 14 are unwound. The draw cord collecting reels 12 and 14 at this point are disengaged from the shaft and are free wheeling in a counterclockwise direction except for the drag hereinafter described. To prevent the rotational momentum of the reels to exceed the rotational speed of the rotating cover collecting drum, a braking force is exerted on the side walls of the reel equivalent to the pressure exerted on the side walls of the reel by the brake shoes 60 and 62. The pressure exerted is sufficient to create a drag which will prevent the reels from rotating at a rate faster than the rate of rotation of the pool cover collecting drum 30. After the pool cover has been completely retracted and collected on drum 30, the electric motor is stopped by manual or automatic means.

When the cover is to be extended over the swimming pool, the electric motor is reversed causing the shaft 16 to rotate in a counterclockwise direction. Such movement activates the cam and cam slot 26 forcing the shaft to move axially and thereby engage the draw cord collecting reels 12 and 14. At this point the cover collecting drum becomes free wheeling. The rotational momentum of the reels 12 and 14 are controlled by the force exerted on the reels by brake shoes 60 and 62.

Engagement of the reels 12 and 14 by the clutch means 25 continues until such time that the pool cover is fully extended and the electric motor is manually or automatically turned off. The electric motor is reversed and the pool cover roll is engaged by reversing the electric motor.

Figure 7:
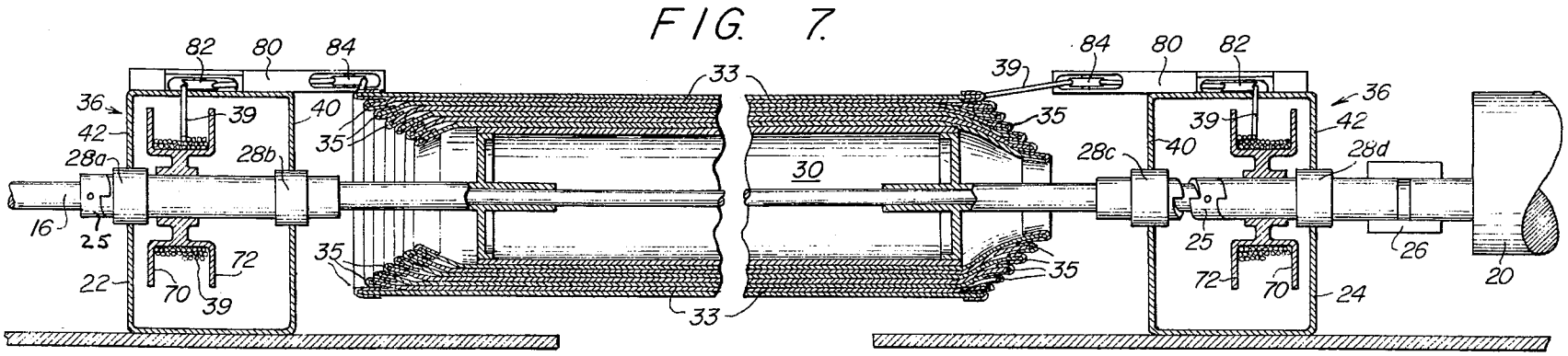
FIG. 7 is a perspective view showing the pool cover in a partially extended position and showing the relationship between the draw cords, the pool cover and draw cord collecting reels.
Figure 6:
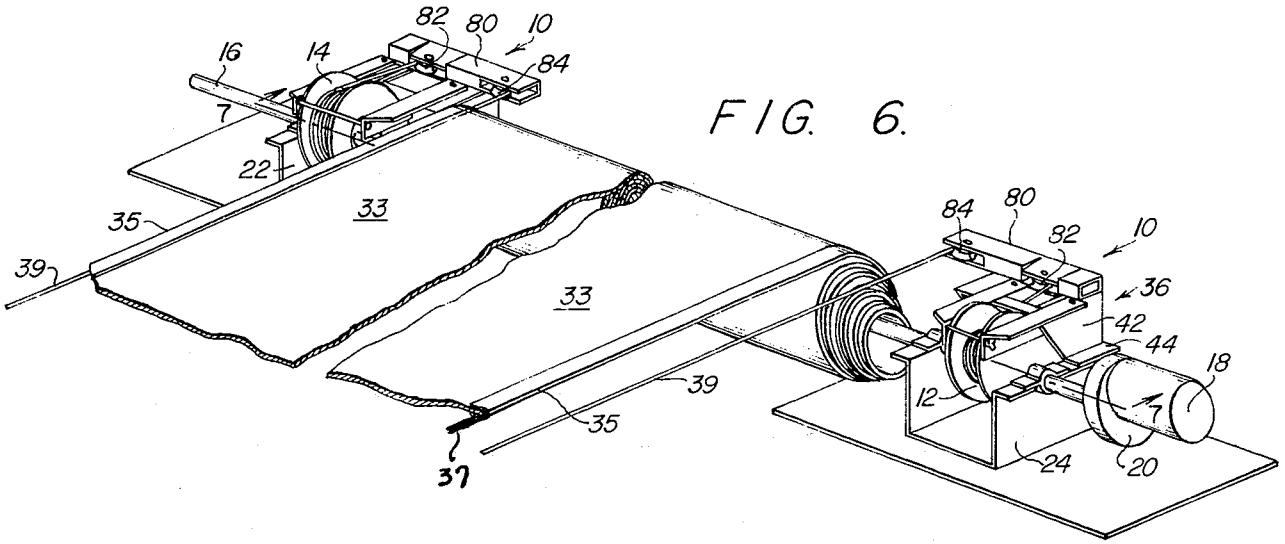
FIG. 6 is a front elevation of the cover collecting drum with the cover collected thereon being cut away.

As more clearly seen in FIGS. 6 and 7, the swimming pool cover is collected on the cover collecting drum which is preferably shorter in length than the width of the swimming pool cover. During collection, the beaded portion of the swimming pool cover overhangs onto the tapered or reduced diameter end sections of the cover collecting drum. By application of a braking force against the side walls of the draw cord collecting reels, the pool cover is compactably collected on the cover collecting drum with the beaded or thickened portion of pool cover being collected in the tapered or reduced diameter end sections of the cover collecting drum. This arrangement permits the pool cover to be evenly collected on the cover collecting drum and minimizes pool cover biasing during collection which can result if the roll is uneven.

Whereas certain preferred embodiments have herein been illustrated and described as the best modes of carrying out this invention, it should be understood that various changes may be made without departing from the inventive concepts disclosed herein which are limited only by the claims appended hereto.

I claim:

1. In an improved swimming pool cover apparatus which includes a swimming pool cover having one of its ends fixed to a cover collection drum carried on a rotatable shaft to permit the swimming pool cover to be collection on said drum and released therefrom, draw cords connected to the non-fixed end of said swimming pool cover and extending out and back for connection to a pair of draw cord collecting reels carried on said shaft and positioned one on either side of said cover collection drum, means for selectively rotating said cover collecting drum and said draw cord collecting reels and thereby permit the swimming pool, said improvement comprising a pair of spaced apart arms pivotally mounted at one of its ends to a support member mounted in proximity of said draw cord collecting reels for movement in a plane horizontal thereto, opposing brake shoes mounted to said arms and a means for urging said brake shoes toward each other.

2. The improved swimming pool cover apparatus of claim 1 wherein said support member comprises a substantially U-shapesd stand having a pair of side walls and a top wall to which said spaced apart arms are pivotally fixed.

3. The improved swimming pool cover apparatus of claim 1 whereby said means for urging said brake shoes toward each other is adjustable.

* * * * *

UNITED STATES PATENT OFFICE

CERTIFICATE OF CORRECTION

Patent No. 4,060,860 Dated December 6, 1977

Inventor(s) JOE H. LAMB

It is certified that error appears in the above-identified patent and that said Letters Patent are hereby corrected as shown below:

In claim 1, line 13 after the word "pool" insert the following; -- cover to be extended and retracted over a swimming pool --

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*